United States Patent [19]

Klingelhofer et al.

[11] Patent Number: 5,057,355

[45] Date of Patent: Oct. 15, 1991

[54] COMPOSITE PLATE, ESPECIALLY FOR RAISED FLOORS

[76] Inventors: Ulrich Klingelhofer, Neubaustrasse 7, D-8702 Waldbuettelbrunn, Fed. Rep. of Germany; Max Mengeringhausen, deceased, late of Wurzburg, Fed. Rep. of Germany; by Horst Klose, legal representative, Durrbachtal 30, D-8700 Wurzburg, Fed. Rep. of Germany

[21] Appl. No.: 208,132

[22] Filed: Jul. 25, 1988

[30] Foreign Application Priority Data

Jun. 19, 1987 [DE] Fed. Rep. of Germany ..... 3720238

[51] Int. Cl.[5] ..... F32B 23/02

[52] U.S. Cl. ..... 428/192; 428/332; 428/138; 428/179; 428/213; 428/218; 52/126.6

[58] Field of Search ..... 428/34.1, 70, 703, 179, 428/138, 166, 192, 332, 213, 218; 52/126.6, 799, 806, 223, 406, 618, 619, 782, 630, 802, 821; 312/257

[56] References Cited

U.S. PATENT DOCUMENTS 4,640,854 2/1987 Radtke ..... 428/34.1

4,833,845 5/1989 Brückner ..... 52/126.6

*Primary Examiner*—Ellis P. Robinson
*Assistant Examiner*—J. Weddington
*Attorney, Agent, or Firm*—Laubscher, Presta & Laubscher

[57] ABSTRACT

With the composite plates for raised floors which are supported at their four corners and consist of a shell with open top and manufactured of tension-resistant material as well as a filling of pressure-resistant material, for instance anhydrite, when the plate is under stress there is a higher deflection at the plate border than in the middle of the plate, which is undesirable. In order to substantially equalize the bearing strength of composite plates of the above structural design in the border and the middle of the plate and to assure such plates against rupture at the border, a reinforcement which is practically plate-high is provided on the side wall of the shell, which is connected with the bottom plate of the shell. In addition or alternatively thereto the density and strength of the filling in the border area of the composite plate could also be increased at least twofold as compared with the rest of the area extending toward the middle of the plate.

12 Claims, 4 Drawing Sheets

COMPOSITE PLATE, ESPECIALLY FOR RAISED FLOORS

BACKGROUND OF THE INVENTION

The invention relates to a composite plate, especially for raised floors to be supported at the corners, consisting of a shell which is open at the top, manufactured of tension-resistant material, preferably sheet steel, and a filling of pressure-resistant material, of which the density and strength can vary within a relatively wide range, and also with anchoring means in the shell for generating a binding effect between the filling and the shell and a reinforcement connected with the bottom plate of the shell.

A composite plate which is similar to the above structural plate is known from German Patent 20 04 101 and has a shell of sheet steel forming the outside wrapper of the plate and also has a pressure-resistant material embedded in the shell, and the pressure-resistant material is generally concrete or anhydrite. This shell is produced by the deep-drawing manufacturing process, the result of which is that the material of the side walls which are drawn upward during manufacture is less thick than the material of the bottom plate of the shell. Because of this more than anything else, the bearing strength or respectively the carrying capacity of such a composite plate is considerably greater in the middle than at its border. The danger therefore arises that when this composite plate is carrying a load, for instance, when it is travelling with a heavy truck filled with files, the border of the plate becomes gradually further deflected than the middle of the plate. Thus a step occurs in the configuration of the plate and with each impact of the truck of files against said step there occurs one more instance of dynamic stress, which with repetition can lead to permanent deformation of the composite plate or even to destruction of the material (formation of tears in the shell and/or the filling).

The drawbacks described above also arise with composite plates in which the thickness of the material of the side walls is identical to that of the floor plate of the shell and/or in which, as in German Offenlegungsschrift 24 45 854, reinforcement rods are welded to the floor plate of the shell adjacent to the side walls. With the just aforementioned composite plates, too, upon application of progressively higher stress the deflection at the border of the plate is greater than the middle of the plate, since the moments of inertia and resistance on the border of the plate are not sufficiently heightened as a result of the presence of reinforcement rods welded to the floor plate of the shell.

With known composite plate embodiments, in which the armoring traditionally is embedded within the concrete or the like (cf. for instance German Patent 26 16 317), in comparison with the composite plate of the presently described structural type with a shell-shaped outside wrapper, the light construction characteristics, in other words the ratio between the carrying capacity of the composite plate of Haus and its own weight, is considerably less favorable, so that simply because of these factors these composite plates do not even come into consideration in this case.

SUMMARY OF THE INVENTION

The object of the invention is to further develop a composite plate with a shell forming an outside wrapper of tension-resistant material and a filling of pressure-resistant material, so that under identical stress either in the middle of the plate or at the borders, its deflection in the middle and at the borders still remains practically identical.

In the present invention, the above purpose is attained in that reinforcement is provided in the side walls of the shell and is constructed in such a manner and/or in that the density and strength of the filling in the border area of the composite plate in comparison with the remaining area extending toward the middle of the plate is such that it is at least twice as great in comparison, so as to provide assurance of the composite plate against rupture and so that the bearing strength is essentially equalized at the border and in the middle of the plate. A composite plate which is supported at its corners and having the features according to the present invention has the advantage that its bearing strength in the border area is adapted to the bearing strength of the middle of the plate and the danger which has been present until this time when using known composite plates, which is the creation of a permanent deformation or even destruction of the material at the border of the plate as a result of the stress, is considerably decreased.

The requirements arising in practice can also be fulfilled more simply than before, by use of the present invention, whereupon the stress capacity of a raised floor plate is determined in that the deflection at the weakest point may not be any greater than 1/300 of the distance between support points and on the other hand a certain assurance against rupture must also be guaranteed, in other words in that the allowable stress may correspond to only a part, for instance half, of the breaking load. The aforementioned deflection in the composite plate according to the invention can actually be maintained to be practically identical at all points—assuming that an identical degree of strain is present at all of these points—and preferably maintained by the reinforcement on the side walls of the shell, generally configured to be as high as the plate, in order to attain a suitably great moment of inertia.

It is also advantageous that the invention can be used in connection with various different filler materials in order to obtain composite plates of different weights. This is very important with regard to the reduction of manufacturing, shipment and assembly costs. In other words, the invention allows for the manufacture of composite plates of different weights with correspondingly different bearing strength, but nonetheless in any case ensures that the bearing strength is practically the same at all points of the composite plate.

Other configurations of the invention are defined in the dependent claims. When the composite plate has a shell, which is manufactured of one piece of a flat sheet metal plate by bending the border strips upward between cut out corners and welding the contact edges to the corners of the shell, it is advisable and appropriate to roll over the border strips of the flat plate of sheet metal at least so far as to double the thickness of the side walls of the shell, and to bend it upward and weld it to its contact edges. In this manner a very simple reinforcement of the height of the plate is formed in the side walls of the shell while the thickness of the material in the border area of the shell bottom plate is also maintained.

According to another configuration of the invention the reinforcement is formed by planar material or an angle profile attached to the inside and/or outside of the sheet metal walls of the shell, for instance, with the use of adhesive or by welding on. The measure can be used advantageously with shells which are manufactured by different processes, including by deep drawing.

Still another configuration of the invention is characterized in that the shell is of two pieces made up of a sheet metal bottom plate provided with anchoring means and together with a profile framework forming the reinforced side walls of the shell, of which the wall thickness is at least three times the thickness of the bottom plate, and that the bottom plate may be connected with the profile framework for instance by means of spot welding. Such a shell, of which the reinforced side walls are formed by profile framework, and which includes a simple flat-surfaced bottom sheet metal plate as the bottom plate of the shell, is especially economical in its manufacture and leads to a composite plate exhibiting a correspondingly remarkable manufacturing cost reduction.

When, according to still another configuration of the invention, the borders of the bottom plate are additionally deformed to increase the moment of resistance in the border area of the structural plate, then the binding effect between the filling of pressure-resistant material and the shell in the border area is also advantageously heightened.

Still another configuration of the invention is characterized in that the planar material or the angle profiles for reinforcement of the shell side walls incorporate a greater structural height in the middle area between the corners of the shell and with that a greater moment of resistance than the adjoining areas adjacent to the corners of the shell. The weight of the composite plate is thus reduced and the advantages of the invention are retained.

BRIEF DESCRIPTION OF THE DRAWINGS

The invention is explained hereinafter relative to the drawings of the exemplary embodiments.

DESCRIPTION OF THE PREFERRED EMBODIMENTS

Figure 1A:
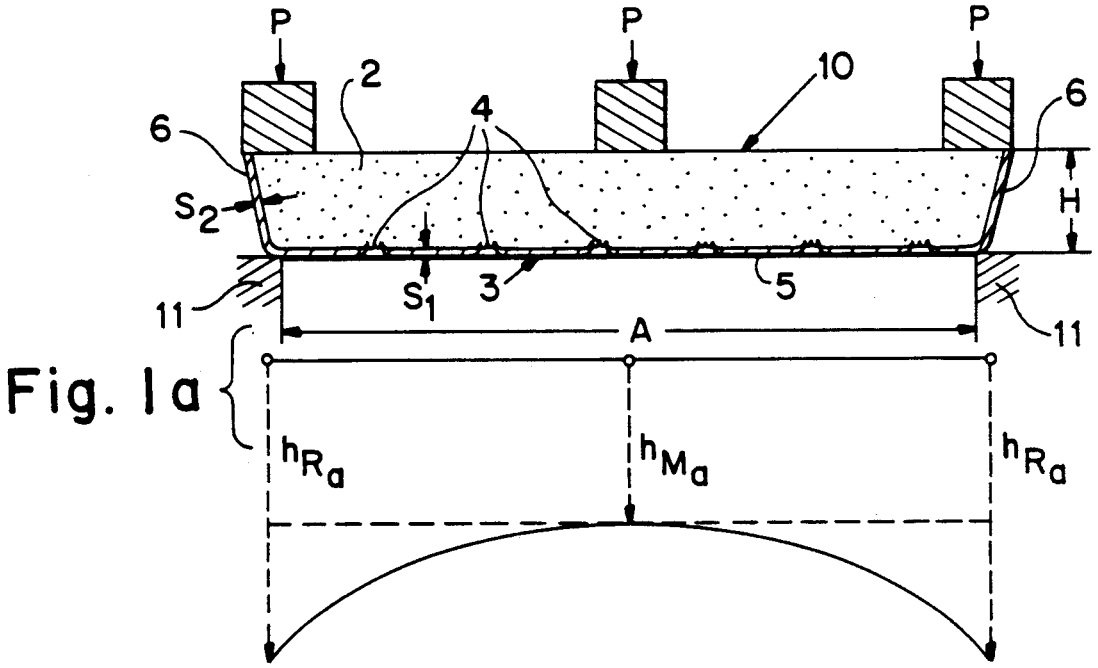
FIG. 1*a* is a transverse cross-sectional view of a composite plate of known structure, supported at its corners and with a stress P applied on its borders as well as in the middle in connection with a diagrammatic representation of the deflection of the composite plate which is generated by these stresses, shown exaggerated in size and detail for the clearest understanding.

A composite plate (10) is shown in FIG. 1*a*, in cross-sectional view at the top, where it is supported at its four corners on only diagrammatically shown supporting legs (11) and for instance is used to make up a raised floor. Composite plate (10) includes a shell (3) which is manufactured of sheet steel with a filling (2) of a pressure-resistant material, for instance concrete or anhydrite. The binding effect between shell (3) forming the outside wrapper for structural plate (10) and filler (2) is attained by anchoring means (4), which in the present case consist of apertures with inward drawn toothed borders of said apertures (so-called punches) in the shell bottom plate (5). Sheet steel shell (3) is manufactured by the deep drawing method, and the shell bottom plate (5) is of the original sheet metal thickness S 1, while the side walls (6) are made up of a sheet metal of thickness S 2, reduced in comparison with the sheet metal thickness S 1 because they are generated by the deep drawing method.

The cross-sectional view of composite plate (10) diagrammatically shows the deformation which occurs in turn when the plate is placed under the effect of a perpendicular load P at its borders or in the middle while plate (10) is being supported only at its four corners. It is obvious that in the case of this known composite plate (10) the deflection hMa in the middle is considerably lower than the deflection hRa at the borders of the plate. The weakest points of composite plate (10) are therefore to be found at its borders and the weakest points determine its carrying capacity, which nonetheless is unfavorable. The international standard for the carrying capacity of raised floor plates requires that the deflection at the weakest point of the plate be no greater than 1/300 of the distance of the spacing A between mounts or supports.

Figure 1B:
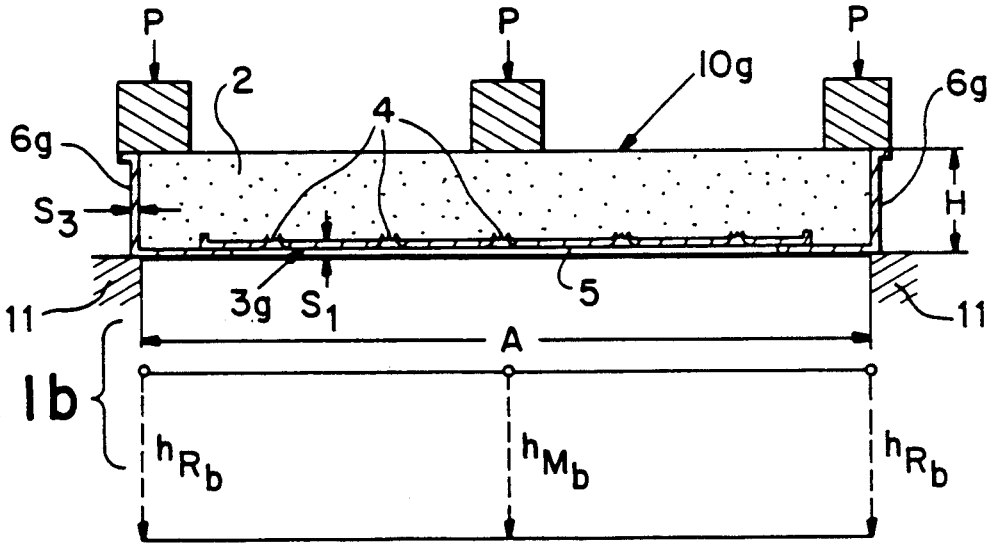
FIG. 1*b* is a transverse cross-sectional view similar to that of FIG. 1, but of a composite plate with the features according to the present invention, likewise with a diagrammatic representation of the deflection of the composite plate which is generated by the stresses.

A composite plate (10*g*) is shown in FIG. 1*b* which in its outside dimensional size corresponds to composite plate (10) of FIG. 1 and as a raised bottom plate is likewise supported at its four corners on support legs (11). Composite plate (10*g*) has a shell (3*g*) configured in accordance with the present invention, as in the embodiment of FIG. 2*g*, and under the identical stress application conditions as in the example of FIG. 1*a*, the deflection hMb in the middle of the plate is essentially as great as the deflection hRb at the borders of the plate. In other words, the bearing strength of composite plate (10*g*) is practically identical at its borders and in the middle of the plate. The shell (3*g*) (cf. also FIG. 2*g*) of composite plate (10*g*) is produced in two pieces. A profile framework (of a Z profile) here forms the reinforced side walls (6*g*) of shell (3*g*), of which the thickness S4 is a multiple (at least three times) of the thickness S1 of a bottom plate (7), which is fastened to the inward projecting shanks of the profile framework, for instance by spot welding (9). Bottom plate (7) is provided with traditional anchoring openings (4) to anchor the filling (2) of pressure-resistant material, and it has an additional rolled-over or turned-up edge (7*a*) on its four borders, which increases the binding effect and simultaneously additionally reinforces the border area of the composite plate. Filling (2) in this exemplary embodiment covers the total plate cross section with the same thickness and strength. The reinforcement of side walls (6*g*) of shell (3*g*) in any case as compared with the floor plate of the shell is of such dimensions that the bearing strength of composite plate (10g) is practically identical at its borders and in the middle.

Figure 2A:
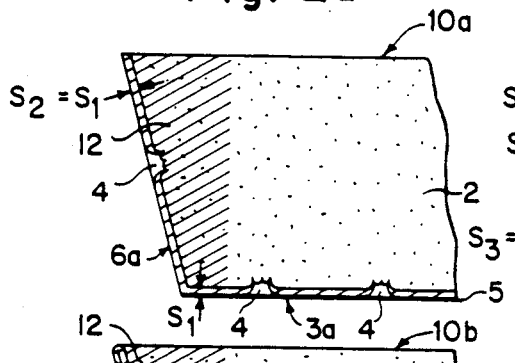
FIG. 2*a* is a partial cross-sectional view of a composite plate in which the thickness and strength of the filling is greater in its border area than in the remaining area.
Figure 2D:
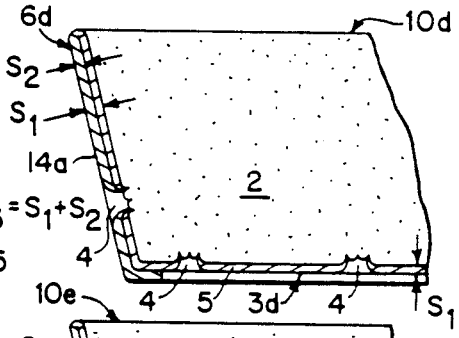
FIGS. 2*b* to 2*g* are different partial cross-sectional views of composite plates in which the side walls of the shell are reinforced differently according to the present invention.
Figure 2B:
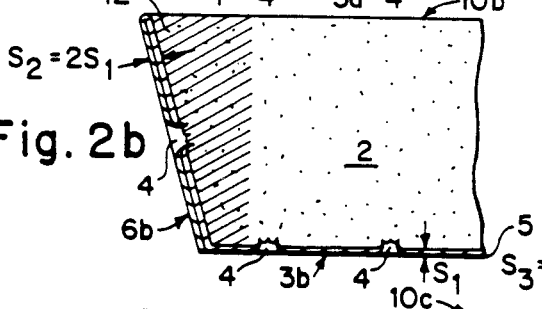
Figure 2E:
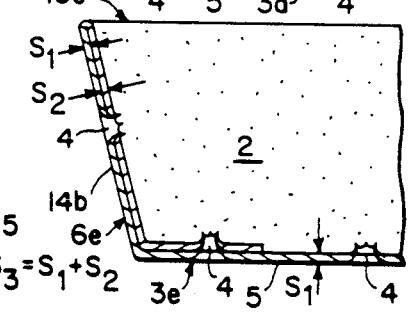
Figure 2C:
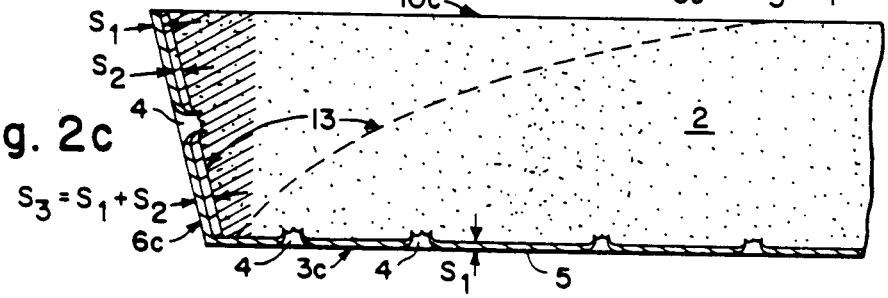
Figure 2F:
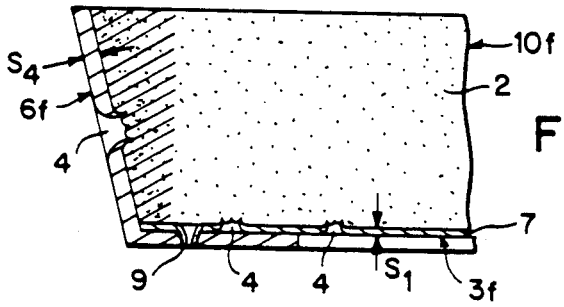

The composite plate (10f) shown in FIG. 2f also includes a shell (3f) of two pieces. The side walls (6f) of shell (3f) consist of an L profile framework member, of which the thickness of the wall S4 is a multiple (at least three times) of the wall thickness S1 of bottom plate (7). This bottom plate (7) may for instance be fastened to the inward projecting shanks of the profile framework by spot welds (9) and includes anchoring apertures (4) for filling (2), which are also provided in side walls (6f) of shell (3f). The bearing strength of these composite plates (10f) having foundation members or supports at the four corners is essentially identical at its borders and in the middle. Thus, filling (2) of pressure-resistant material can have the same density and strength over the entire cross-section of the plate.

As opposed to the exemplary embodiments of the invention described up to this point, the composite plate (10a) of FIG. 2a incorporates shell (3a) as the outside wrapper for filling (2) of pressure-resistant material, in which the wall thickness S1 of shell bottom plate (5) is identical to the thickness S2 of the side walls (6a) of the shell. The equalization of the bearing strength of this composite plate (10a) at the border and in the middle of the plate having foundation members or supports at its four corners in this case occurs in such a manner that its border area is statically stabilized or reinforced in that the pressure-resistant filling (2) in border area (12) has a higher weight per unit of volume and a higher pressure resistance than in the remaining parts of the plate cross section. This is attained for instance in that the original filling (2) introduced at relatively lower density into shell (3a) is correspondingly more greatly compacted by the effect of pressure in border area (12).

The composite plate (10b) shown in FIG. 2b consists of shell (3b) of sheet steel and a filling (2) of pressure-resistant material, for instance anhydrite. In this exemplary embodiment the side walls (6b) of shell (3b) are doubled over so that they are twice as thick as shell bottom plate (5). This reinforcement of side walls (6b) of shell (3b) can, for instance, be produced by means of a manufacturing process which is explained in more detail relative to FIGS. 3a to 4. Filling (2) can be of identical density and strength over the entire plate cross-section or preferably can have an even higher weight per unit of volume and a higher pressure resistance in the border area (12), analogous to the exemplary embodiment of FIG. 2a. The side walls of the shell could also be three or four times as thick as the shell bottom plate. Four times the thickness would be preferred.

The exemplary embodiment of a composite plate (10c) shown in FIG. 2c includes a shell (3c) in the form of an outside wrapper which corresponds primarily to that of FIG. 2a; in other words, it has the same wall thickness S1 at all points. The reinforcement on side walls (6c) of shell (3c) is embodied in that a planar material or respectively planar steel sheet (13) with wall thickness S2 is attached to the side walls or respectively to the sheet metal walls of the original shell, by welding, by application of adhesive or by pressure-jointing technology and also in connection with providing punches (4), so that the entire thickness of shell side walls (6c) is $S3=S1+S2$. In the exemplary embodiment shown in FIG. 2c, the planar material (13) is mounted on the insides of the side walls of the original shell, but it can also be applied on the outside and in any case is constructed essentially as high as the plate. The thickness S3 of side walls (6c) in the embodiment of FIG. 2c is some multiple of the thickness S1 of shell bottom plate (5). As shown in broken lines in FIG. 2c, the structural height of planar material (13) increases progressively away from the shell corners toward the middle of the plate only between the corners of the shell and reaches its greatest value in the middle between the shell corners. Providing the anchoring with filling (2), apertures (4) extend their frayed borders (punches) inward in this exemplary embodiment, even through side walls (6c) of the shell and at the same time serve to form the connection between the planar material (13) and the sheet metal walls of the shell. Filling (2) of pressure-resistant material in this case can once again have identical density and strength over the entire plate cross-section.

In the exemplary embodiments of FIGS. 2d and 2e, the side walls (6d or respectively 6e) of the relevant shells (3d, 3e) are reinforced similarly to the exemplary embodiment of FIG. 2(b) except that in composite plates (10d or respectively 10e) the wrapped border strips are angled downward on the outside or respectively on the inside and are used in addition to the reinforcement of the shell side walls (6d or respectively 6e). Here too the punches (4) could service additionally as components of the connection.

Figure 2G:
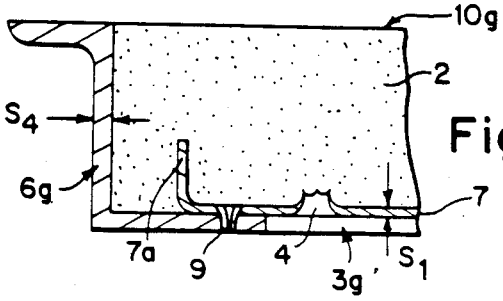
Figure 4:
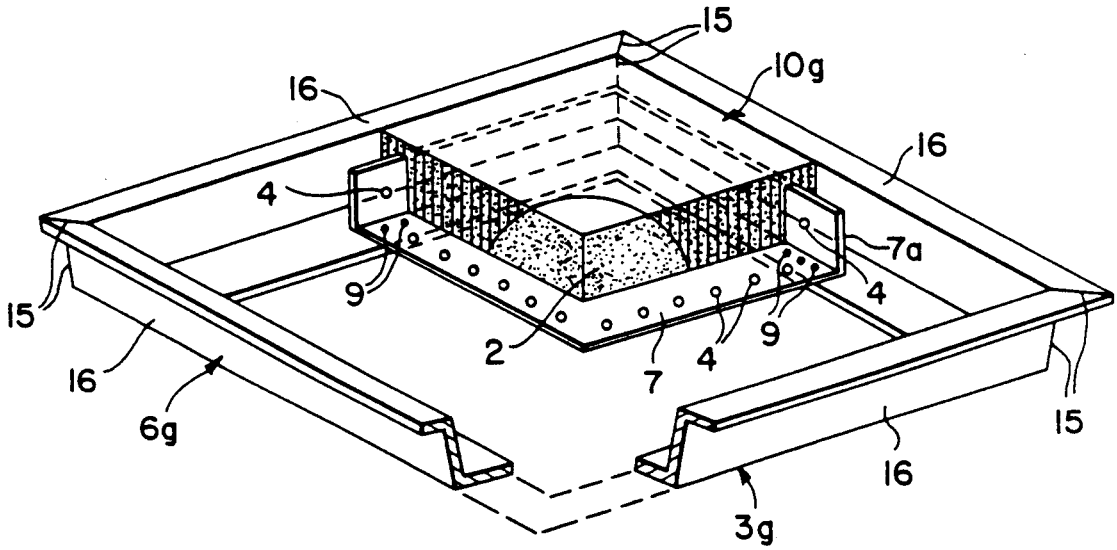
* and FIG. 4 is a perspective view of a cut out composite plate corresponding to the embodiment shown in FIG. 2*g*.

The composite plate (10g) shown only in partial cross-section in FIG. 2g is represented in more detail in FIG. 4. This drawing clarifies that side walls (6g) of shell (3g) are formed of a Z profile frame, which in turn is composed of four profile members (16), which are trimmed at their corners (15) until they are beveled and then are welded together. The profile framework members forming the shell side walls (6f) of the embodiment of FIG. 2f can be manufactured in the same manner. The upward turned folds (7a) in the bottom sheet metal plate (7) or respectively in the shell bottom plate could likewise be stipulated to further heighten the binding effect between shell (3g) and filling (2) by means of apertures (4).

Figure 3A:
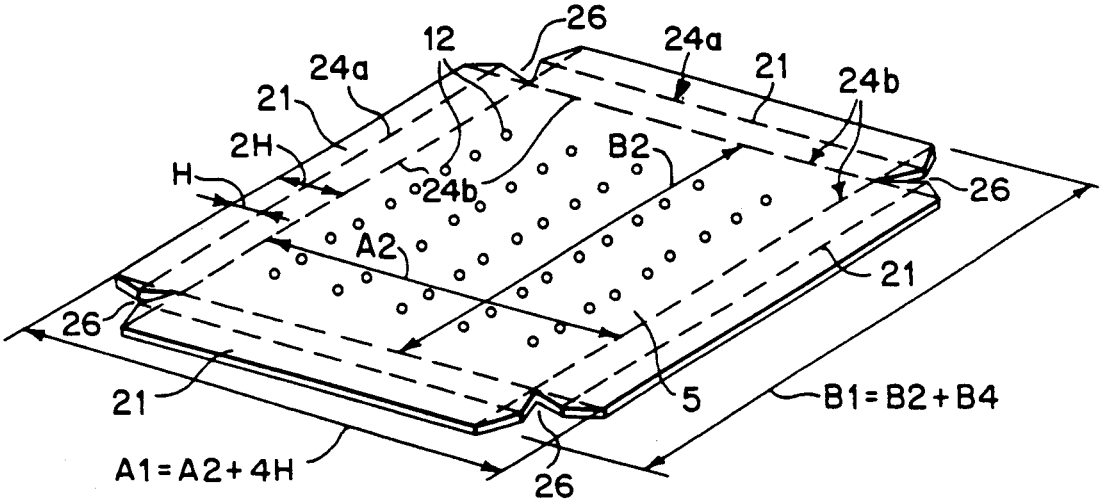
FIGS. 3*a* to 3*c* are perspective views showing different phases in the production of a shell with reinforced side walls from a flat-surfaced section of sheet metal by the upward turning and wrapping of border strips between cut out corners to form a composite plate as shown in FIG. 2*b.
Figure 3B:
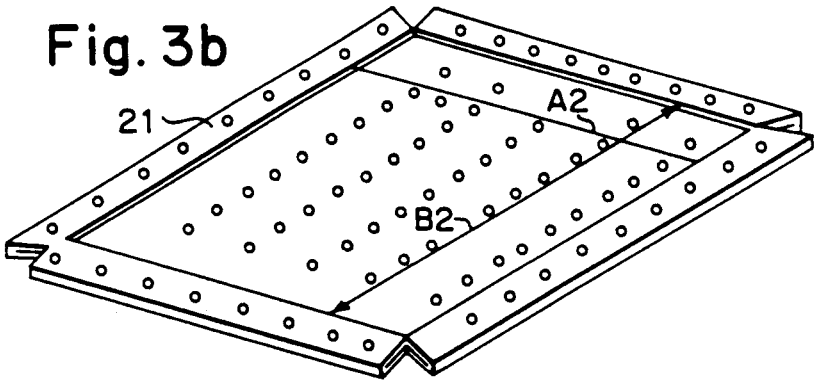
Figure 3C:
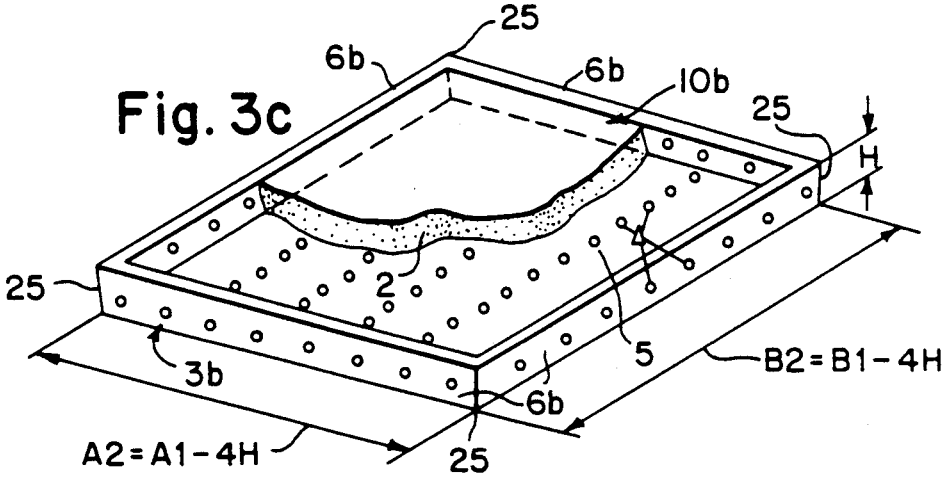

The series of drawings FIGS. 3a to 3c show the manufacture of the shell (3b) for composite plate (10b) of FIG. 2b, of which the side walls (6b) are of twice the thickness of shell bottom plate (5). The flat-surfaced segment of sheet metal shown in FIG. 3a serves as starting material to make shell (3b), of which the outside measurements A1 and B1 are greater by the value 4H than the bottom plate measurements A2 and B2 of shell (3b) shown in completed state in FIG. 3c. Cutouts (26) are punched out at the corners of the sheet metal segment of FIG. 3a, so as to form border strips (21) with a crosswise dimension of 2H between the punched-out corners.

Then as shown in FIG. 3b the border strips (21) are first of all wrapped around bending lines (24a) and with that step the material is doubled in thickness, whereupon the doubled over border strips are bent upward around the folding lines (24b), until they meet at their ends. At their meeting points the doubled over border strips (21) are finally connected together for instance by weld seams (25). The completed shell (3b) is shown in FIG. 3c with a part of filling (2) of pressure-resistant material, which has greater strength in the area of the border than in the other areas.

Various pressure-resistant materials could be used as filling (2), according to the specifications for use of the composite plates. To make particularly high quality composite plates, mineral filler materials may be provided for instance in the form of anhydrite or concrete, as used until this time. For composite plates which will be subjected to lower stresses, however, lighter weight fillers could also be used, for instance synthetic resin could be used as binder (plastic-light concrete), or plaster cement binding filler materials with light concrete aggregate materials (for instance wood chips or perlite) could be used. The weight per unit of volume and the pressure resistance of filling (2) could thus be varied within a wide range, but then the thickness S1 of the shell bottom plate must always be adapted to the weight per unit of volume of filling (2).

It is claimed:

1. Composite plate, especially for raised floor plate constructions to be supported at the corners, comprising a shell having side walls and being open at the top, manufactured of tension-resistant material, a filling of pressure-resistant material, anchoring means in the shell for generating a binding effect between the filling and the shell, and reinforcing plate means connected to the shell, characterized in that the reinforcing plate means is provided on the side walls of the shell for increasing the thickness thereof so that it is at least twice the thickness of the bottom of the shell so that the bearing strength of the composite plate is substantially equalized in the border and the middle of the plate, whereby assurance is provided against rupture at the border.

2. Composite plate as in claim 1, in which the shell is made of one segment of a flat sheet metal plate by turning border strips upward between cutout corners and welding the contacting edges at the corners of the shell, characterized in that the border strips (21) of the flat sheet metal plate are folded back at least sufficiently to double the thickness of the shell side walls (6*b*), are bent upward and are welded to their contact edges (25).

3. Composite plate as in claim 1, characterized in that the reinforcing means is formed by reinforcing members fastened to the side walls of the shell.

4. Composite plate as in claim 1, characterized in that the shell is of two pieces and is manufactured of a bottom plate of sheet metal (7) provided with anchoring means (4) and also of reinforced side walls connected to the bottom plate, the wall thickness (S4) of the side walls being at least three times the thickness (S1) of the bottom plate (7).

5. Composite plate as in claim 4, characterized in that the borders (7*a*) of the bottom plate of sheet metal (7) are additionally deformed to increase the moment of resistance in the border area of the plate (10*g*).

6. Composite plate as in claim 3, characterized in that the reinforcing members for reinforcement of the shell side walls have a greater structural height in the middle areas between the corners of the shell, whereby said middle areas have a greater moment of resistance than those areas adjacent to the corners of the shell.

7. Composite plate as in claim 3, characterized in that the reinforcing members are formed of generally flat sheet material.

8. Composite plate as in claim 3, characterized in that the reinforcing members are angled members.

9. Composite plate as in claim 3, characterized in that the reinforcing members are fastened to the inside of the side walls.

10. Composite plate as in claim 3, characterized in that the reinforcing members are fastened to the outside of the side walls.

11. Composite plate as in claim 1, characterized in that the density and strength of the filling in the border area of the composite plate is at least twice as great as the density and strength of the filling in the remaining area extending toward the middle of the plate.

12. Composite plate, especially for raised floor plate constructions to be supported at the corners, comprising a shell which is open at the top, manufactured of tension-resistant material, a filling of pressure-resistant material, and also with anchoring means in the shell for generating a binding effect between the filling and the shell, characterized in that the density and strength of the filling in the border area of the composite plate in comparison with the remaining area extending toward the middle of the plate is such that it is at least twice as great by comparison so that the bearing strength of the composite plate is substantially equalized in the border and the middle of the plate, whereby assurance is provided against rupture at the border.

* * * * *